US007727695B2

(12) United States Patent
Hirano et al.

(10) Patent No.: US 7,727,695 B2
(45) **Date of Patent: *Jun. 1, 2010**

(54) ELECTROPHOTOGRAPHIC TONER

(75) Inventors: Shiro Hirano, Tokyo (JP); Yoshiyasu Matsumoto, Tokyo (JP); Masaaki Kondo, Tokyo (JP); Junya Onishi, Tokyo (JP); Aya Shirai, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 589 days.

This patent is subject to a terminal disclaimer.

(21) Appl. No.: 11/626,169

(22) Filed: Jan. 23, 2007

(65) Prior Publication Data

US 2007/0184374 A1 Aug. 9, 2007

(30) Foreign Application Priority Data

Feb. 9, 2006 (JP) ..... 2006-032375

(51) Int. Cl.
*G03G 9/08* (2006.01)

(52) U.S. Cl. ..... 430/108.8

(58) Field of Classification Search ..... 430/108.8
See application file for complete search history.

(56) References Cited

U.S. PATENT DOCUMENTS 6,040,103 A * 3/2000 Ohno et al. ..... 430/108.8
2006/0172211 A1* 8/2006 Ueda et al. ..... 430/108.4

* cited by examiner

*Primary Examiner*—Janis L Dote
(74) *Attorney, Agent, or Firm*—Lucas & Mercanti, LLP

(57) ABSTRACT

An electrophotographic toner is disclosed, comprising a binding resin, a colorant and a releasing agent, wherein the releasing agent comprises a first releasing agent component and a second releasing agent component, the first releasing agent component is a straight chain hydrocarbon compound exhibiting a melting point of 50 to 100° C. and the second releasing agent component is a branched hydrocarbon compound exhibiting a melting point of 50 to 100° C., and the second releasing agent component accounting for 5% to 90% by mass of the total amount of the first and second releasing agent components.

8 Claims, 2 Drawing Sheets

ELECTROPHOTOGRAPHIC TONER

BACKGROUND OF THE INVENTION

1. Technical Field

The present invention relates to toners for use in electrophotography.

2. Related Art

In response to demand for energy-saving in electrophotographic image forming apparatuses, to reduce energy consumed in the fixing device, whose consumption of electric power is the highest in the image forming apparatus, low-temperature fixing to perform image fixing at a relatively low temperature is promoted. To achieve low-temperature fixing, it is necessary to melt a toner and a mold releasing agent (hereinafter, also denoted as a releasing agent) at a relatively low fixing temperature, and it is contemplated to use a toner and a releasing agent (wax) which exhibit a low melt viscosity. Further, to obtain a toner responding to such a low fixing temperature, it is necessary to use a releasing agent exhibiting a relatively low melting point and toners obtained by use of releasing agents exhibiting a low melting point (hereinafter, also referred to as a low-melting releasing agent) were proposed, as described in, for example, JP-A Nos. 2000-321815 and 2000-275908 (hereinafter, the term, JP-A refers to Japanese Patent Application Publication).

However, it was proved that there arose problems that banded or streaked image defects were often caused in fixing of images formed by toners using such a low-temperature releasing agent.

SUMMARY OF THE INVENTION

The present invention has come into being in light of the foregoing. Accordingly, it is an object of the invention to provide a toner which achieves sufficient releasing capability by using a releasing agent of a relatively low melting point, resulting in formation of superior fixed images in which occurrence of image defects such as banded or streaked images are inhibited.

The inventors analyzed banded or streaked image defects occurring in fixed images formed by a toner using a low-melting releasing agent to elucidate the causes thereof and obtained findings with respect to releasing agents to inhibit occurrence of such image defects.

Specifically, analysis of causes revealed that releasing agent molecules adhered to the interior of the device, resulting in inhibited charging behavior or causing mirror staining. Releasing agents, which inherently exhibit a low melting point but also exhibit an extremely high boiling point, were not conventionally considered to be capable of vaporizing. It is assumed that lowering a melting point of a releasing agent to achieve low-temperature fixing lowered the vapor pressure at a temperature lower than the boiling point, resulting in an increase of releasing agent molecules which were vaporized at the temperature of a fixing device or an increase of releasing agent molecules having a easily vaporizable structure. Namely, it was proved that when forming images through heat-fixing by using a toner containing a low-melting releasing agent, the low-melting releasing agent which contained easily vaporizable components generated vaporized components at a temperature in the interior of the device and the vaporized components were attached to the wire of a charger, causing unevenness in charging or the vaporized components adhered to a polygonal mirror, causing striped defects in exposure, and then leading to occurrence of image defects. Thus, it was found that inhibiting generation of vaporizable components of the low-melting releasing agent minimized occurrence of image defects, leading to realization of the invention.

One aspect of the invention is directed to an electrophotographic toner comprising a binding resin, a colorant and a releasing agent, wherein the releasing agent comprises a first releasing agent component of a straight chain hydrocarbon compound exhibiting a melting point of 50 to 100° C. and a second releasing agent component of a branched hydrocarbon compound exhibiting a melting point of 50 to 100° C., and the second releasing agent component accounting for 5% to 90% by mass of the total amount of the first and second releasing agent components.

Another aspect of the invention is directed to an image forming method comprising fixing a toner image formed on a transfer material by using the foregoing toner at a fixing nip section of the fixing device of a contact heating system, wherein the toner image is fixed at the fixing nip section at a fixing temperature higher by 10 to 50° C. than the melting point of the releasing agent.

The toner according to the invention contains a releasing agent, which comprises a specific first releasing agent component and a second releasing agent component and the releasing agent as a whole exhibits a relatively low melting point but is difficult to produce volatile components, so that fixing is performed basically at a sufficient-fixing strength even at a relatively low fixing temperature, generating no banded or streaked image defect in the fixed image, whereby superior fixed images can be obtained.

Specifically, a straight chain hydrocarbon compound as the first releasing agent component and a branched hydrocarbon compound both exhibit a relatively low melting point and the straight chain hydrocarbon compound is easily fusible due to its simple structure so that sufficient releasing ability is achieved in the releasing agent as a whole even when fixed at a low fixing temperature. Further, the branched hydrocarbon compound is difficult to produce volatile components so that production of volatile components is inhibited in the overall releasing agent. The reason why the branched hydrocarbon compound is difficult to produce volatile components is not clear but it is assumed that the branched hydrocarbon compound exhibits a relatively low melting point as a molecule but easily causes inter-winding between molecules due to such a branched chain or cyclic structure, resulting in formation of a structure which is difficult to produce volatile components.

Specifically, the straight chain hydrocarbon compound of the first releasing agent component easily produces volatile components in respect of its structure and low molecular weight. Further, it is assumed that when the straight chain hydrocarbon compound and the branched hydrocarbon compound which are similar in composition, are mixed, they are sufficiently miscible with each other, resulting in intermolecular involvement of the branched and straight chain hydrocarbon compounds.

DETAILED DESCRIPTION OF THE INVENTION

Figure 1:
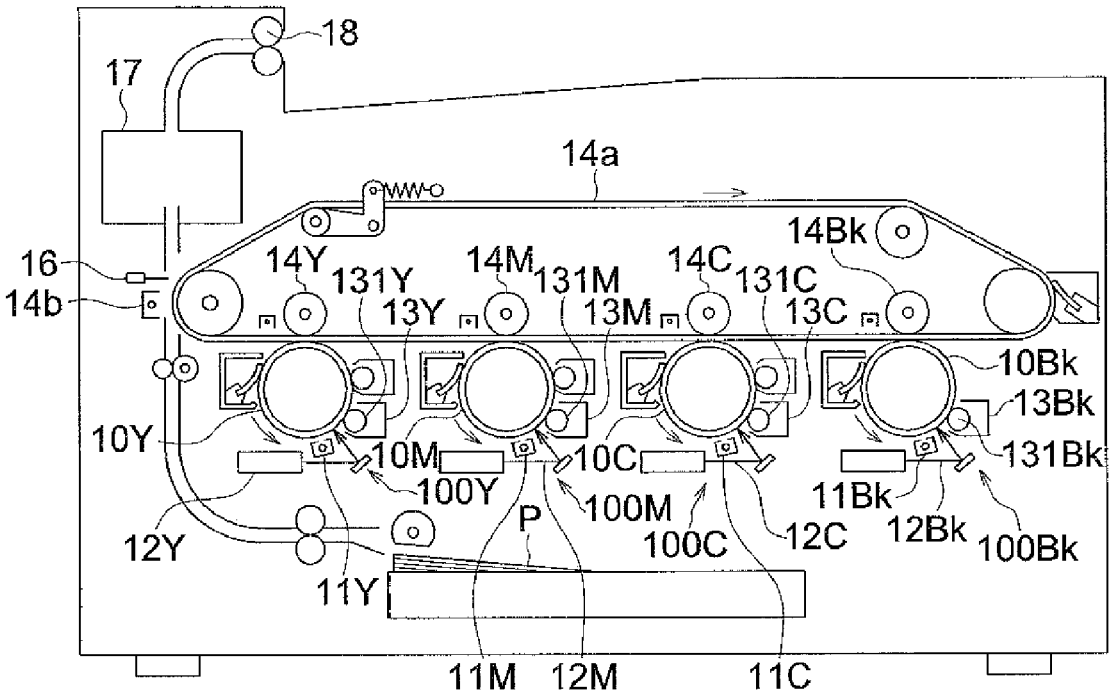
FIG. 1 illustrates an example of an image forming apparatus for use in an image forming method using the toner of the invention.

The toner of the invention contains a binding resin, a colorant and a releasing agent. The releasing agent comprises the first releasing agent component of a straight chain hydrocarbon compound exhibiting a melting point of 50 to 100° C. and the second releasing agent component of a branched hydrocarbon compound exhibiting a melting point of 50 to 100° C. and the second releasing agent component accounts for 5 to 90% (preferably 10% to 60%) by weight of the whole releasing agent.

When the second releasing agent component accounts for more than 90% by mass, superior releasing capability due to a straight chain hydrocarbon compound of the first releasing agent component cannot be achieved. When the second releasing agent component accounts for less than 5% by mass, inhibition of production of volatile components is not sufficiently achieved, leading to defects of fixed images.

The content of the second releasing agent component contained in the releasing agent is regarded as its proportion to be incorporated. In cases when determined from a toner, the content of the second releasing agent component can be calculated from the proportion of tertiary and quaternary carbon atoms constituting a branched hydrocarbon compound of the overall releasing agent (which is a ratio of branching) and the ratio of branching of the second releasing agent component which has been determined in advance.

Examples of a straight chain hydrocarbon compound of the first releasing agent component include a petroleum wax such as paraffin wax and synthetic waxes such as Fischer-Tropsch wax and polyethylene wax. Paraffin wax is one obtained by separation from vacuum-distillate oil. Fischer-Tropsch wax is a hydrocarbon compound having 16-78 carbon atoms, which is obtained by hydrogenating distillation residue of hydrocarbons synthesized from synthetic gas comprising carbon monoxide and hydrogen. Polyethylene wax is one synthesized through polymerization of ethylene or thermal cracking of polyethylene.

The straight chain compound of the invention preferably exhibits a weight-average molecular weight of 300 to 500 and also preferably a number-average molecular weight of 300 to 500 and more preferably 400 to 500. The ratio of weight-average molecular weight to number-average molecular weight Mw/mn is preferably 1.0 to 1.20.

Two or more straight chain hydrocarbon compounds may be used in combination, as the first releasing agent component constituting the releasing agent of the toner of the invention.

Specific examples of a hydrocarbon compound having a branched chain structure include microcrystalline waxes such as HNP-0190, HI-MIC-1045, HI-MIC-1070, HI-MIC-1080, HT-MIC-1090, HI-MIC-2045, HT-MIC-2065 and HT-MIC-2095 (produced by Nippon Seiro Co., Ltd.) and waxes mainly containing an iso-paraffin wax, such as waxes EMW-0001 and EMW-0003. A microcrystalline wax which is one of petroleum waxes and differs from a paraffin wax which is mainly comprised of a straight chain hydrocarbon (normal paraffin), is a wax in which the proportion of branched chain hydrocarbons (iso-paraffin) and cyclic hydrocarbons (cycloparaffin) is relatively high. Generally, a microcrystalline wax, which is mainly comprised of low-crystalline isoparaffin and cycloparaffin, is composed of smaller crystals and exhibits a larger molecular weight, compared to a paraffin wax. Such a microcrystalline wax has 30 to 60 carbon atoms, a weight-average molecular weight of 500 to 800 and a melting point of 80 to 90° C.

A microcrystalline wax, as a hydrocarbon compound having a branched chain structure is preferably one having 30 to 60 carbon atoms, a weight-average molecular weight of 600 to 800 and a melting point of 60 to 85° C. Further, a paraffin wax having a number-average molecular weight of 300 to 1,000 (preferably 400 to 800) is preferred. The ratio of weight-average molecular weight to number-average molecular weight (Mw/Mn) is preferably from 1.01 to 1.20.

Manufacturing methods to obtain a hydrocarbon compound having a branched chain structure include, for example, a press-sweating method in which solidified hydrocarbon is separated, while maintaining raw oil at a specific temperature and a solvent extraction method in which a solvent is added to raw oil of vacuum distillation residual oil or heavy distillates of petroleum to cause crystallization and is further subjected to filtration. Among these methods, the solvent extraction method is preferred. A hydrocarbon compound having a branched chain structure which can be obtained by the manufacturing methods described above is colored and may be purified by using a sulfuric acid clay and the like.

The content of the branched hydrocarbon compound contained in the releasing agent of the invention is determined from the proportion of tertiary and quaternary carbon atoms constituting a branched hydrocarbon compound, based on total carbon atoms constituting the whole releasing agent (which is also denoted as a ratio of branching or simply as a branching ratio), according to the manner described below. The ratio of branching is preferably from 0.1% to 20%. When the branching ratio falls within the range of 0.1-20%, the branched hydrocarbon compound renders it difficult to produce volatile components. The branching ratio of the whole releasing agent containing first and second releasing agent components is preferably 0.01% to 5%.

Specifically, the branching ratio of a branched hydrocarbon compound can be determined according to the following equation (1) based on a spectrum obtained in 13C-NMR spectrometry under conditions as below:

branching ratio (%)=[(C3+C4)/(C1+C2+C3+C4)]×100 wherein C3 represents a peak area related to tertiary carbon atoms, C4 represents a peak area related to quaternary carbon atoms, C1 represents a peak area related to primary carbon atoms and C2 represents a peak area related to secondary carbon atoms.

Condition of 13C-NMR spectrometry:

Measuring apparatus: FT NMR spectrometer Lambda 400 (produced by Nippon Denshi Co., Ltd.)
Measuring frequency: 100.5 MHz
Pulse condition: 4.0 μs
Data point: 32768
Delay time: 1.8 sec
Frequency range: 27100 Hz
The number of integratings: 20000
Measurement temperature: 80° C.
Solvent: benzene-d6/o-dichlorobenzene-d4=¼ (v/v)
Sample concentration: 3% by mass
Sample tube: ϕ 5 mm
Measurement mode: 1H complete decoupling method.

At least two hydrocarbon compounds having a branched chain structure may be used in combination as the second releasing agent component of the releasing agent used in the toner of the invention.

In the releasing agent constituting the toner of the invention, the first releasing agent component preferably exhibits a melting point of 50 to 100° C. and more preferably 55 to 90° C., and the second releasing agent component preferably exhibits a melting point of 50 to 100° C. and more preferably 55 to 90° C.

The melting point represents a temperature at the top of an endothermic peak of the releasing agent, which can be determined by using, for example, DSC-7 differential scanning calorimeter (produced by Perkin Elmer, Inc.) or TAC7/DX thermal analyzer controller (produced by Perkin Elmer, Inc.).

To be more concrete, 4.00 mg of a releasing agent is weighed at a precision to two places of decimals and enclosed in an aluminum pan (KITNO. 0219-0041), and then set onto a DSC-7 sample holder. Temperature control of Heat-Cool-Heat is carried out, while measuring conditions of a measurement temperature of 0 to 200° C., a temperature-increasing speed of 10° C./min and temperature-decreasing speed of 10° C./min, and analysis was conducted based on the data of the 2nd Heat. Measurement for reference was performed using an empty aluminum pan.

The releasing agent of the invention (or the first and second releasing agent components) is incorporated to the toner of the invention preferably in an amount of 1% to 30% by mass of a binding resin, and more preferably 5% to 20%.

Methods for manufacturing the toner of the invention are not specifically limited and examples thereof include a pulverization method, a suspension polymerization method, a mini-emulsion polymerization coagulation method, an emulsion polymerization coagulation method, a solution suspension method and a polyester molecule elongation method. Of these methods, the mini-emulsion polymerization coagulation method is specifically preferred, in which, in an aqueous medium containing a surfactant at a concentration lower than the critical micelle concentration, a polymerizable monomer solution containing a releasing agent dissolved in a polymerizable monomer is dispersed by employing mechanical energy to form oil droplets (10 to 1000 nm) to prepare a dispersion; to the prepared dispersion, a water-soluble polymerization initiator is added to perform radical polymerization to obtain binding resin particles; the obtained binding resin particles were coalesced (coagulated and fused) to obtain a toner. In the foregoing method, polymerization is performed in the form of oil droplets so that in the individual toner particles, releasing agent molecules are definitely enclosed in the binding resin. It is therefore supposed that generation of volatile components of the releasing agent is inhibited until subjected to fixing in a fixing device or heated. In the foregoing mini-emulsion polymerization coagulation method, an oil-soluble polymerization initiator may be added to the monomer solution, instead of or concurrently with addition of the water-soluble polymerization initiator.

In the method of manufacturing the toner of the invention, binding resin particles formed in the mini-emulsion polymerization coagulation method may be formed of at least two layers, in which to a dispersion of first resin particles prepared by mini-polymerization according to the conventional manner (the first step polymerization), a polymerization initiator and a polymerizable monomer are added to perform polymerization (the second step polymerization).

To be more specific, the mini-emulsion polymerization coagulation method, as a manufacturing method of the toner comprises:

(1) solution/dispersion step in which toner particle constituent materials such as a releasing agent, a colorant and optionally, a charge controlling agent are dissolved or dispersed in a polymerizable monomer to form a binding resin to obtain a polymerizable monomer solution, (2) polymerization step in which the polymerizable monomer solution is dispersed in the form of oil-droplets dispersed in an aqueous medium and polymerized through mini-emulsion polymerization to prepare a dispersion of binding resin particles, (3) coagulation/fusion step in which the binding resin particles are allowed to be salted out, coagulated and fused to form coalesced particles, (4) ripening step in which the coalesced particles are thermally ripened to control the particle form to obtain a dispersion of toner particles, (5) cooling step in which the toner particle dispersion is cooled, (6) filtration/washing step in which toner particles are separated through solid/liquid separation from the cooled toner particle dispersion, and surfactants and the like are removed from the toner particles, (7) drying step in which the washed toner particles are dried, and (8) a step of adding external additives to the dried toner particles (external addition treatment).

The individual steps are further detailed below.

(1) Solution/Dispersion:

This step comprises dissolving or dispersing toner particle constituent materials such as releasing agents and colorants in a polymerizable monomer to form a polymerizable monomer solution. The releasing agents are added in such an amount that the content of the releasing agents falls within the range described earlier. The polymerizable monomer solution may be added with an oil-soluble polymerization initiator and/or other oil-soluble components.

(2) Polymerization:

In one suitable embodiment of the polymerization step, the foregoing polymerizable monomer solution is added to an aqueous medium containing a surfactant at a concentration lower than the critical micelle concentration and mechanical energy is applied thereto to form oil-droplets, subsequently, polymerization is performed in the interior of the oil-droplets by radicals produced from a water-soluble polymerization initiator. Resin particles as nucleus particles may be added to the aqueous medium in advance.

Binding resin particles containing reducing agents and a binding resin are obtained in the polymerization step. The obtained binding resin particles may or may not be colored. The colored binding resin particles can be obtained by subjecting a monomer composition containing a colorant to polymerization. In cases when using non-colored binding resin particles, a dispersion of colorant microparticles is added to a dispersion of binding resin particles, and the colorant particles and the binding resin particles are coagulated to obtain toner particles.

The aqueous medium refers to a medium that is composed mainly of water (at 50% by mass or more). A component other than water is a water-soluble organic solvent. Examples thereof include methanol, ethanol, isopropanol, butanol, acetone, methyl ethyl ketone and tetrahydrofuran. Of these solvents, alcoholic organic solvents such as methanol, ethanol, isopropanol and butanol are specifically preferred.

Methods for dispersing a polymerizable monomer solution in an aqueous medium are not specifically limited but dispersion by using mechanical energy is preferred. Dispersing machines to perform dispersion by using mechanical energy are not specifically limited and examples thereof include CLEAR MIX (produced by M Technique Co., Ltd.), an ultrasonic homogenizer, a mechanical homogenizer, a MANTON-GAULIN homomixer and a pressure homogenizer. The dispersed particle size is preferably within the range of 10 to 1000 nm, and more preferably 30 to 300 nm.

(3) Coagulation/Fusion:

In the coagulation/fusion step, in cases when the binding resin particles are non-colored, a dispersion of colorant microparticles is added to the dispersion of binding resin particles, obtained in the foregoing polymerization step, and allowing the binding resin particles to be salted out, coagulated and fused with the colorant microparticles. In the course of the coagulation/fusion step, binding resin particles differing in resin composition may further be added to perform coagulation. In the coagulation/fusion step, particles of internal additives such as a charge-controlling agent may be coagulated together with binding resin particles and colorant microparticles.

Coagulation/fusion is performed preferably in the following manner. To an aqueous medium including binding resin particle and colorant microparticles, a salting-out agent composed of alkali metal salts and/or alkaline earth metal salts is added as a coagulant at a concentration of more than the critical coagulation concentration and then heated at a temperature higher than the glass transition point of the binding resin particles and also higher than the melting peak temperature of a releasing agent used therein to perform salting-out concurrently with coagulation/fusion.

In the coagulation/fusion step, it is necessary to perform prompt rise in temperature by heating and the temperature raising rate is preferably not less than 1° C./min. The upper limit of the temperature raising rate is not specifically limited but is preferably not more than 15° C./min in terms of inhibiting formation of coarse particles due to a rapid progress of salting-out, coagulation and fusion.

After a dispersion of binding resin particles and colorant microparticles reaches a temperature higher than the glass transition point of the binding resin particles and also higher than the melting peak temperature of a releasing agent, it is essential to maintain that temperature of the dispersion over a given time to allow salting-out, coagulation and fusion. Thereby, growth of toner particles (coagulation of binding resin particles and colorant microparticles) and fusion (dissipation of interfaces between particles) effectively proceed, leading to enhanced durability of the toner.

A dispersion of colorant microparticles can be prepared by dispersing colorant microparticles in an aqueous medium. Dispersing colorant microparticle is performed at a surfactant concentration in water higher than the critical micelle concentration (CMC). Dispersing machines used for dispersing colorant microparticles are not specifically limited but preferred examples thereof include pressure dispersing machines such as an ultrasonic disperser, a mechanical homogenizer, a MANTON-GAULIN homomixer or a pressure homogenizer, and a medium type dispersing machines such as a sand grinder, a GETTSMAN mil or a diamond fine mill.

The colorant particles may be those which have been subjected to surface modification treatments. Surface modification of the colorant particles is affected, for example, in the following manner. A colorant is dispersed in a solvent and thereto, a surface-modifying agent is added and allowed to react with heating. After completion of the reaction, the colorant is filtered off, washed with the same solvent and dried to produce a surface-modified colorant (pigment).

(4) Ripening:

Ripening is performed preferably by using thermal energy (heating). Specifically, a system including coagulated particles is stirred with heating, while controlling the heating temperature, a stirring speed and heating rate until the shape of toner particles reaches the intended average circularity.

In the ripening step, the toner particles obtained above may be used as core particles and binding resin particles are further attached and fused onto the core particles to form a core/shell structure. In that case, the glass transition point of binding resin particle constituting the shell layer is preferably higher by at least 20° C. than that of binding resin particles constituting the core particles.

When binding resin particles used in the coagulation/fusion step are composed of a resin made from a polymerizable monomer containing an ionically dissociative group (hydrophilic resin) and a resin made from a polymerizable monomer containing no ionically dissociative group (hydrophobic resin), toner particles having a core/shell structure may be formed by disposing the hydrophilic resin on the surface side of the coagulated particle and the hydrophobic resin in the inside of the coagulated particle.

(5) Cooling:

This step refers to a stage that subjects a dispersion of the foregoing toner particles to a cooling treatment (rapid cooling). Cooling is performed at a cooling rate of 1 to 20° C./min. The cooling treatment is not specifically limited and examples thereof include a method in which a refrigerant is introduced from the exterior of the reaction vessel to perform cooling and a method in which chilled water is directly supplied to the reaction system to perform cooling.

(6) Filtration/Washing:

In the filtration and washing step, a solid-liquid separation treatment of separating toner particles from a toner particle dispersion is conducted, then cooled to the prescribed temperature in the foregoing step and a washing treatment for removing adhered material such as a surfactant or salting-out agent from a separated toner particles (aggregate in a cake form) is applied. In this step, washing is conducted until the filtrate reaches a conductivity of 10 μS/cm. A filtration treatment is conducted, for example, by a centrifugal separation, filtration under reduced pressure using a NUTSCHE funnel or filtration using a filter press, but the treatment is not specifically limited.

(7) Drying:

In this step, the washed toner cake is subjected to a drying treatment to obtain dried colored particles. Drying machines usable in this step include, for example, a spray dryer, a vacuum freeze-drying machine, or a vacuum dryer. Preferably used are a standing plate type dryer, a movable plate type dryer, a fluidized-bed dryer, a rotary dryer or a stirring dryer. The moisture content of the dried toner particles is preferably not more than 5% by mass, and more preferably not more than 2%. When toner particles that were subjected to a drying treatment are aggregated via a weak attractive force between particles, the aggregate may be subjected to a pulverization treatment. Pulverization can be conducted using a mechanical pulverizing device such as a jet mill, HENSCHEL mixer, coffee mill or food processor.

(8) External Additive Addition:

In this step, the dried colored particles are optionally mixed with external additives to prepare a toner. There are usable mechanical mixers such as a HENSCHEL mixer and a coffee mill.

Commonly known various resins, for example, vinyl resin such as styrene resin, (meth)acryl resin, styrene-(meth)acryl copolymer resin and olefinic resin, polyester resin, polyamide resin, polycarbonate resin, polyether resin, polyvinyl acetate) resin, polysulfone resin, epoxy resin, polyurethane resin, and urea resin are used, as a binding resin constituting the toner of the invention, in toner particles manufactured by a pulverization method or a solution suspension method. These resins can be used alone or in combination.

In toner particles manufactured by a suspension polymerization, a mini-emulsion polymerization coagulation method or an emulsion polymerization coagulation method, examples of a polymerizable monomer to obtain a resin forming the toner particles include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, and vinylidene fluoride; vinyl esters such as vinyl propionate, vinyl acetate, and vinyl benzoate; vinyl ethers such as vinyl methyl ether and vinyl ethyl ether; vinyl ketones such as vinyl methyl ketone, vinyl ethyl ketone, and vinyl hexyl ketone; N-vinyl compounds such as N-vinylcarbazole, N-vinylindole, and N-vinylpyrrolidone; vinyl compounds such as vinylnaphthalene and vinylpyridine; as well as derivatives of acrylic acid or methacrylic acid such as acrylonitrile, methacrylonitrile, and acryl amide. These vinyl based monomers may be employed individually or in combinations.

Further preferably employed as polymerizable monomers, which constitute the toner of the invention, are those having ionic dissociative groups in combination, and include, for instance, those having substituents such as a carboxyl group, a sulfonic acid group, and a phosphoric acid group, as the constituting groups of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, and 3-chloro-2-acid phosphoxypropyl methacrylate.

Further, it is possible to prepare resins having a cross-linking structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, and neopentyl glycol diacrylate.

In manufacturing the toner particles of the invention by the suspension polymerization method, a mini-emulsion polymerization coagulation method or emulsion polymerization coagulation method, surfactants used for obtaining a binding resin are not specifically limited but ionic surfactants described below are suitable. Such ionic surfactants include sulfates (e.g., sodium dodecylbenzenesulfate, sodium arylalkylpolyethersulfonate, sodium 3,3-disulfondisphenylurea-4,4-diazo-bis-amino-8-naphthol-6-sulfonate, ortho-carboxybenzene-azo-dimethylaniline, sodium 2,2,5,5-tetramethyltriphenylmethane-4,4-diazo-bis-β-naphthol-6-sulfonate) and carboxylates (e.g., sodium oleate, sodium laurate, sodium caprate, sodium caprylate, sodium caproate, potassium stearate, calcium oleate). Nonionic surfactants are also usable. Examples thereof include polyethylene oxide, polypropylene oxide, a combination of polypropylene oxide and polyethylene oxide, an ester of polyethylene glycol and a higher fatty acid, alkylphenol polyethylene oxide, an ester of polypropylene oxide and a higher fatty acid, and sorbitan ester. These surfactants are used as an emulsifying agent when manufacturing the toner by an emulsion polymerization method but may also be used in other processes or for other purposes.

In manufacturing the toner particles of the invention by the suspension polymerization method, a mini-emulsion polymerization coagulation method or an emulsion polymerization coagulation method, binding resin can be obtained through polymerization by using radical polymerization initiators.

Specifically, oil-soluble radical polymerization initiators are usable in suspension polymerization and examples of an oil-soluble polymerization initiator include azo- or diazo-type polymerization initiators, e.g., 2,2'-azobis-(2,4-dimethylvaleronitrile), 2,2'-azobisisobutylonitrile, 1,1'-azobis(cyclohexane-1-carbonitrile), 2,2' azobis-4-methoxy-2,4-dimethylvaleronitrile, azobisisobutylonitrile; peroxide type polymerization initiators, e.g., benzoyl peroxide, methyl ethyl ketone peroxide, diisopropylperoxycarbonate, cumene hydroperoxide, t-butyl hyroperoxide, di-t-butyl peroxidedicumyl peroxide, 2,4-dichlorobenzoyl peroxide, lauroyl peroxide, 2,2-bis-(4,4-t-butylperoxycyclohexyl)-propane, tris-(t-butylperoxy)triazine; and polymeric initiators having a side-chain of peroxide.

Water-soluble radical polymerization initiators are usable in an emulsion polymerization method or emulsion polymerization coagulation method. Examples of a water-soluble polymerization initiator include persulfates such as potassium persulfate and ammonium persulfate; azobisaminodipropane acetic acid salt, azobiscyanovaleric acid and its salt, and hydrogen peroxide.

In manufacturing the toner particles of the invention by the suspension polymerization method, a mini-emulsion polymerization coagulation method or an emulsion polymerization coagulation method, generally used chain-transfer agents are usable for the purpose of controlling the molecular weight of a binding resin. Chain-transfer agents are not specifically limited but examples thereof include mercaptans such as n-octylmercaptan, n-decylmercaptane and tert-dodecylmercaptan; n-octyl-3-mercaptopropionic acid ester, terpinolene, carbon tetrabromide, carbon and α-methylstyrene dimmer.

Commonly known inorganic or organic colorants are usable for the toner of the invention. Specific colorants are as follows.

Examples of black colorants include carbon black such as Furnace Black, Channel Black, Acetylene Black, Thermal Black and Lamp Black and magnetic powder such as magnetite and ferrite.

Magenta and red colorants include C.I. Pigment Red 2, C.I. Pigment Red 3, C.I. Pigment Red 5, C.I. Pigment Red 16, C.I. Pigment Red 48, C.I. Pigment Red 53, C.I. Pigment Red 57, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Orange or yellow colorants include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 74, C.I. Pigment Yellow 93, C.I. Pigment Yellow 94, C.I. and Pigment Yellow 138.

Green or cyan colorants include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66 and C.I. Pigment Green 7.

The foregoing colorants may be used alone or in combination. The colorant content is preferably from 1% to 30% by mass, and more preferably 2% to 20% by mass. Surface-modified colorants are also usable. Commonly known surface modifiers are usable and preferred examples thereof include a silane coupling agent, a titanium coupling agent and an aluminum coupling agent.

Coagulants usable in manufacturing the toner particles of the invention by a mini-emulsion polymerization coagulation method or an emulsion polymerization coagulation method include, for example, alkali metal salts and alkaline earth metal salts. Alkali metals constituting a coagulant include, for example, lithium, sodium and potassium; alkaline earth metals constituting a coagulant include, for example, magnesium, calcium, strontium and barium. Of the foregoing, potassium, sodium, magnesium, calcium and barium are preferred. Counter-ions for the alkali metal or the alkaline earth metal (anion constituting a salt) include, for example, chloride ion, bromide ion, iodide ion, carbonate ion and sulfate ion.

The toner particles of the invention may optionally contain a charge controlling agent. Charge controlling agents usable in the invention include various compound known in the art.

The toner particles of the invention preferably have a number-average particle size of 3 to 8 μm. In manufacturing toner particles by the polymerization methods described earlier, the particle size can be controlled by a coagulant concentration, the addition amount of organic solvents, a fusion time and polymer composition. A number-average particle size falling within the range of 3 to 8 μm not only achieves reproduction of fine lines and enhanced image quality of photographic images but can also reduce toner consumption, compared to the use of a toner of a larger particle size.

The toner particles of the invention exhibit an average circularity of 0.930 to 1.000. The circularity of toners can be measured using FPIA-2100 (produced by Sysmex Co.) according the procedure as follow. A toner is placed in an aqueous surfactant solution, dispersed by using an ultrasonic homogenizer for 1 min., and measured using FPIA-2100 under the measurement condition of HPF mode (high magnification ratio) at an appropriate concentration of the HPF detection number of from 3,000 to 10,000, within the range of which reproducible measurement values can be obtained. The circularity is defined by the following equation (3):

$$\text{Circularity}=\{(\text{circumference of a circle having an area equivalent to the projected area of a particle})/(\text{a circumference of the projected particle})\} \quad (3)$$

The average circularity can be obtained by the sum of circularities of the individual particles, divided by the total number of particles.

To improve flowability or charging property or to enhance cleaning capability, so-called external additives may be added to the toner of the invention. External additives are not specifically limited and a variety of inorganic particles, organic particles and sliding agents are usable as an external additive. Inorganic oxide particles of silica, titania, alumina and the like are preferably used for inorganic particles. The inorganic particles may be surface-treated preferably by using a silane coupling agent, titanium coupling agent and the like to enhance hydrophobicity. Spherical organic particles having an average primary particle size of 10 to 2000 nm are also usable. Polystyrene, poly(methyl methacrylate), styrene-methyl methacrylate copolymer and the like are usable as organic particles.

External additives are incorporated to the toner preferably in an amount of 0.1-0.5% by mass, and more preferably 0.5-4.0% by mass. External additives may be incorporated alone or in combination.

The toner of the invention may be used as a magnetic or nonmagnetic monocomponent developer or as a dicomponent developer together with a carrier. To be more concrete, in cases when the toner is used as a monocomponent developer, a nonmagnetic monocomponent developer and a magnetic monocomponent developer which contains magnetic particles of 0.1 to 0.5 μm in the toner are cited and both are usable. In cases when the toner is used as a dicomponent developer, magnetic particles composed of metals such as iron, ferrite or magnetite, or alloys of the foregoing metals and aluminum or lead are usable as a carrier, and of these, ferrite particles are specifically preferred.

There may also be used a coat carrier of resin-coated magnetic particles and a resin dispersion type carrier in which a fine-powdery magnetic material is dispersed in a binder resin. Coating resins used for the coat carrier are not specifically limited and examples thereof include olefinic resin, styrene resin, styrene-acryl resin, silicone resin, ester resin and fluorine-containing polymer resin. Resins used for the resin dispersion type carrier are not specifically limited and commonly known ones are usable, such as styrene-acryl resin, polyester resin, fluororesin and phenol resin. A coat carrier coated with styrene-acryl resin is cited as a preferred carrier in terms of preventing external additives from being released and durability.

The volume-based median diameter of carrier particles is preferably from 20 100 μm, and more preferably from 25 to 80 μm. The volume-based median diameter of the carrier particles can be determined using a laser diffraction type particle size distribution measurement apparatus provided with a wet disperser, HELOS (produced by SYMPATEC Corp.).

The toner of the invention is suitably used in an image forming method in which a toner image on a transfer material is fixed in a fixing device of a contact heating system.

FIG. 1 illustrates one example of an image forming apparatus for use in an image forming method using the toner of the invention.

The image forming apparatus is a color image forming apparatus of a tandem system in which four image forming units 100Y, 100M, 100C and 100Bk are provided along an intermediate belt 14*a* as an intermediate transfer material.

The image forming apparatus comprises:

image forming units 100Y, 100M, 100C and 100Bk, each of which is composed of a photoconductive layer comprised of a conductive layer and an organic photoreceptor (OPC), formed on the circumferential surface of a cylindrical substrate;

photoreceptor drums 10Y, 10M, 10C and 10Bk which are counter-clockwise rotated by power from a driving source (not illustrated) or by driving an intermediate belt, while the conductive layer is grounded;

charging means 11Y, 11M, 11C and 11Bk which are each composed of a scorotron charger, arranged vertical to the moving direction of the respective photoreceptor drums 10Y, 10M, 10C and 10Bk and provide an electric potential onto the surface of the respective photoreceptor drums 10Y, 10M, 10C and 10Bk by corona discharge of an identical polarity to the toner;

exposing means 12Y, 12M, 12C and 12Bk which perform scanning parallel to the rotating shafts of the photoreceptor drums 10Y, 10M, 10C and 10Bk to perform imagewise exposure, forming latent images on the surface of the photoreceptor drums 10Y, 10M, 10C and 10Bk, based on image data; and developing means 13Y, 13M, 13C and 13Bk which are provided with rotatable development sleeves 131Y, 131M, 131C and 131Bk and convey toners held on the respective sleeves to the surface of the respective photoreceptor drums 10Y, 10M, 10C and 10Bk.

A yellow toner image is formed by the image forming unit 100Y, a magenta toner image is formed by the image forming unit 100M, a cyan toner image is formed by the image forming unit 100C and a black toner image is formed by the image forming unit 100Bk.

In the foregoing image forming apparatus, the individual toner images formed on the photoreceptors 10Y, 10M, 10O and 10Bk of the respective image forming units 100Y, 100M, 100C and 100Bk are successively transferred timely onto transfer material P by transfer means 14Y, 14M, 14C and 14Bk and superimposed to form a color image, transferred together onto the transfer material P in secondary transfer means 14*b*, separated from the intermediate belt 14*a* by a separation means 16, fixed in a fixing device 17 and finally discharged through an outlet 18 from the apparatus.

As a suitable fixing method used in the image forming method as described above is cited a so-called contact heating system. Specific examples of such a contact heating system include a thermo-pressure fixing system, a thermal roll fixing system and a pressure heat-fixing system in which fixing is performed by a fixed rotatable pressure member enclosing a heating body.

Figure 2:
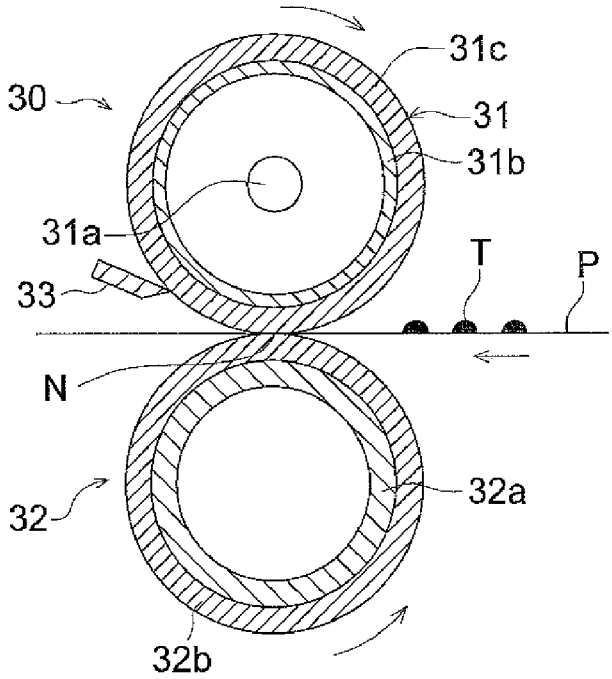
FIG. 2 shows a sectional view of an example of a fixing device of an image forming apparatus using the toner of the invention.

FIG. 2 shows a sectional view of one example of a fixing device in an image forming apparatus using the toner of the invention. A fixing device 30 is provided with heating roller 31 placed into contact with pressure roller 32. In FIG. 2, T designates a toner image formed on transfer material P and numeral 33 is a separation claw.

In a heating roller 31, covering layer 31*c* composed of fluororesin or elastic material is formed on the surface of core 31*b*, in which heating member 31*a* formed of linear heaters is enclosed.

The core 31*b* is constituted of a metal having an internal diameter of 10 to 70 mm. The metal constituting the core 31*b* is not specifically limited, including, for example, a metal such as aluminum or copper and their alloys. The wall thickness of the core 31*b* is in the range of 0.1 to 15 mm and is determined by taking into account the balancing of the requirements of energy-saving (thinned wall) and strength (depending on constituent material). To maintain the strength equivalent to a 0.57 mm thick iron core by an aluminum core, for instance, the wall thickness thereof needs to be 0.8 mm.

When the covering layer 31*c* is composed of fluororesin, examples of such fluororesin include polytetrafluoroethylene (PTFE) and tetraethylene/perfluoroalkyl vinyl ether copolymer (PEA).

The thickness of the covering layer 31*c* composed of fluororesin is usually 10 to 500 μm, and preferably 20 to 400 μm. A fluororesin covering layer thickness of less than 10 μm cannot achieve sufficient functions as a covering layer. On the other hand, a thickness of more than 500 μm easily forms flaws on the covering layer surface, caused by paper powder and a toner or the like is often adhered to a portion of the flaws, causing image staining.

When the covering layer 31*c* is composed of an elastic material, examples of elastic material constituting the covering layer include silicone rubber exhibiting superior heat-resistance, such as LTV, RTV and HTV and silicone sponge rubber. The thickness of the covering layer 31*c* composed of elastic material is usually 0.1 to 30 mm, and preferably 0.1 to 20 mm. The Asker C hardness of an elastic material constituting the covering layer 31*c* is usually less than 80°, and preferably less than 60°.

The heating member 31*a* preferably uses a halogen heater.

The pressure roller 32 is constituted of covering layer 32*b* composed of an elastic material, formed on core 32*a*. The elastic material constituting the covering layer 32*b* is not specifically limited, and examples thereof include soft rubber such as urethane rubber or silicone rubber and sponge. The use of silicone rubber or silicone sponge rubber in the covering layer 31*c* is preferred.

Material constituting the core 32*a* is not specifically limited and examples thereof include metals such as aluminum, iron and copper and the alloys of these metals.

The thickness of the covering layer 32*b* is preferably 0.1 to 30 mm, and more preferably 0.1 to 20 mm.

In one example of fixing conditions of the fixing device shown in FIG. 2, the fixing temperature (the surface temperature of the heating roller 31) is 70 to 210° C. and the fixing linear speed is 80 to 640 mm/sec. The nip width of fixing nip N formed by the heating roller 31 and the pressure roller 32 is 8 to 40 mm, and preferably 11 to 30 mm. The combined load of the heating roller 31 and the pressure roller 32 is usually in the range of 40 to 350 N, and preferably 50 N to 300 N.

Figure 3:
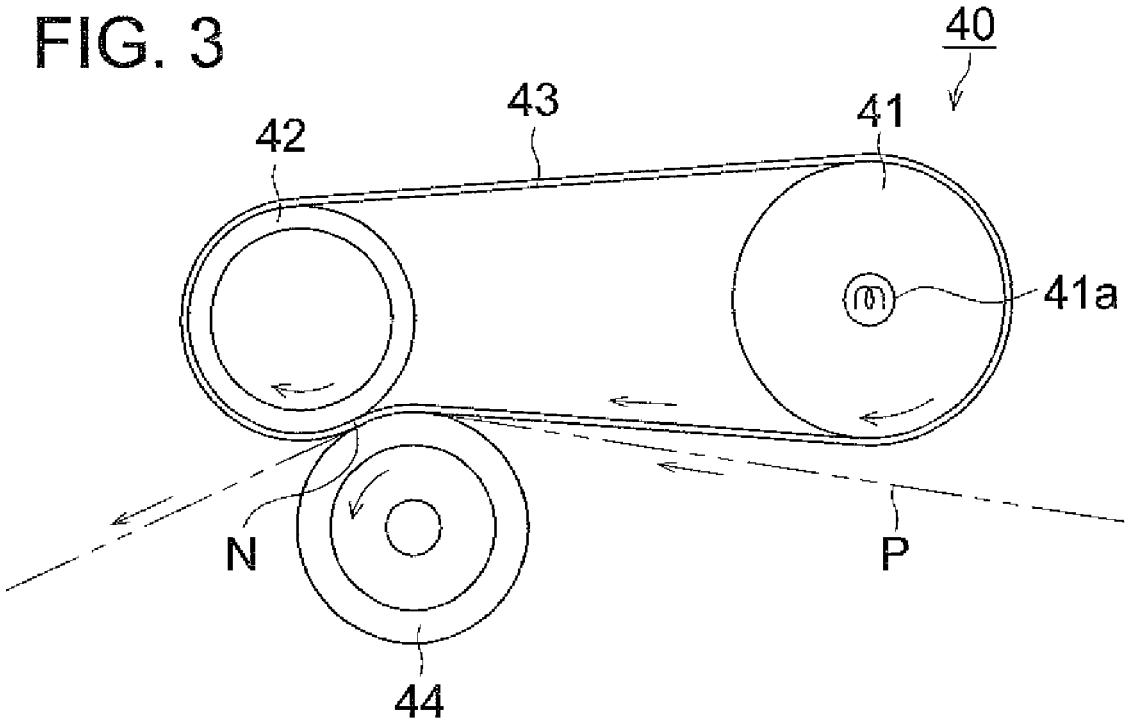
FIG. 3 illustrates another example of a fixing device.
Figure 4:
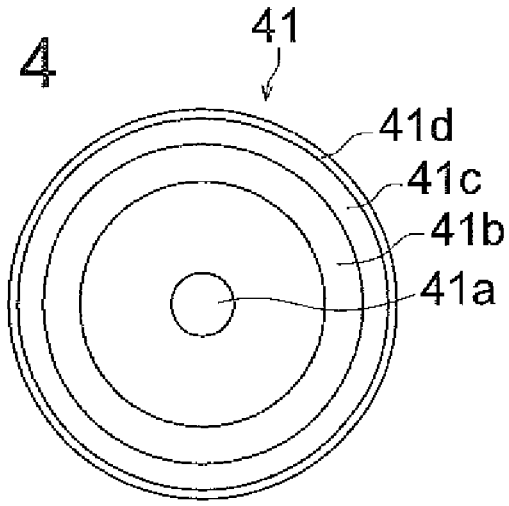
FIG. 4 illustrates an example of constitution of a heating roller used in the fixing device shown in FIG. 3.

FIG. 3 illustrates another example of a fixing device in an image forming apparatus using the toner of the invention, while FIG. 4 illustrates one example of constitution of a heating roller in the fixing device shown in FIG. 3.

Fixing device 40 comprises a heating roller 41 having a heating source 41*a* composed of a halogen lamp, a support roller 42 arranged away from and parallel to the heating roller 41, an endless fixing belt 43 stretched between the heating roller 41 and the support roller 42 and an opposed roller 44 compressed to the support roller 42 via the fixing belt 43, while forming a fixing nip portion N.

In the heating roller 41 of the fixing device 40, a heat-resistant elastic layer 41*c* composed of 1.5 mm thick, for example, silicone rubber is formed on a cylindrical core 41*b* enclosing a halogen heater 41*a* as a heating source and composed of, for example, aluminum, and further thereon, a toner releasing layer 41*d* forming an uppermost layer via 1-3 adhesive layers (not shown) and composed of, for example, PFA resin (tetrafluoroethylene-perfluoroalkyl vinyl ether copolymer) is formed at a thickness of 30 μm.

In the fixing belt 43, for example, an approximately 200 μm thick Si rubber layer is formed on the peripheral surface of an approximately 40 μm thick Ni electro-formed substrate or a 50-100 μm thick polyimide substrate, and further on the peripheral surface of the Si rubber layer, an approximately 30 μm thick covering layer composed of PFA (tetrafluoroethylene-perfluoroalkyl vinyl ether copolymer) or PTFE (polytetrafluoroethylene) is formed.

In the image forming method of the invention, the fixing temperature of the fixing device (which is the surface temperature of the fixing member) is preferably 10 to 50° C. (more preferably 20 to 40° C.) higher than the melting point of a releasing agent. In cases where plural melting point peaks exist, it is preferably higher than the highest melting point peak by the foregoing temperature range.

A transfer material to form an image of the toner of the invention is a support to hold a toner image. Specific examples thereof include plain paper inclusive of thin and thick paper, fine-quality paper, coated paper used for printing, such as art paper or coated paper, commercially available Japanese paper and postcard paper, plastic film used for OHP and cloth, but are not limited to the foregoing.

The toner according to the invention contains a releasing agent, which comprises a specific first releasing agent component and a second releasing agent component and the releasing agent as a whole exhibits a relatively low melting point but is difficult to produce volatile components. Further, the releasing agent forms a structure achieving superior adhesion to a transfer material so that fixing is performed basically at a sufficient-fixing strength even at a relatively low fixing temperature, generating no banded or streaked image defect in the fixed image, whereby superior fixed images can be obtained.

Concretely, a specific monoester compound and a specific hydrocarbon compound having a branched chain structure both exhibit a relatively low melting point but are difficult to produce volatile components. The monoester compound which is a polar molecule achieves superior adhesion to a transfer material, whereby the foregoing effects can be realized. The reason why the hydrocarbon compound having a branched chain structure is difficult to produce volatile components is not clear but it is assumed that the hydrocarbon compound having a branched chain structure exhibits a relatively low melting point as a molecule but easily causes inter-winding between molecules due to such a branched chain or cyclic structure, resulting in formation of a structure which is difficult to produce volatile components.

EXAMPLES

The present invention will be further described with reference to examples but is by no means limited to these examples.

Refining of Branched Hydrocarbon

Raw oils of petroleum reduced-pressure distillation residue oils or heavy distillate oils were subjected to separation through a solvent extraction method and purified to obtain releasing agents 6 and 7 exhibiting the physical properties, as shown in Table 1. The releasing agent 6 exhibited a weight-average molecular weight (Mw) of 700 and a branching ratio of 0.5%, and the releasing agent exhibited a weight-average molecular weight (Mw) of 800 and a branching ratio of 2.0%.

Preparation (1) of Resin Particle Dispersion First Polymerization Step:

To a 5 liter reaction vessel fitted with a stirrer, a temperature sensor, a condenser and a nitrogen gas introducing device was placed 8 g of sodium dodecylsulfate dissolved in 3 liters of deionized water and the internal temperature was raised to 80° C., while stirring at a stirring speed of 0.230 rpm under a nitrogen gas stream. After raised to the said temperature, a solution of 10 g of potassium persulfate dissolved in 200 g of deionized water, then, the liquid temperature was again raised to 80° C. and a polymerizable monomer solution composed of 480 g of styrene, 250 g of n-butylacrylate, 68.0 g of methacrylic acid and 16.0 g of n-octyl 3-mercaptopropionate was dropwise added thereto over a period of 1 hr. After completion of addition, the reaction mixture was heated at 80° C. for 2 hr, with stirring to perform polymerization to prepare a resin particle dispersion (1H) containing resin particles (1h).

Second Polymerization Step:

To a 5 liter reaction vessel fitted with a stirrer, a temperature sensor, a condenser and a nitrogen gas introducing device was placed 7 g of polyoxyethylene 2-dodecyl ether sodium sulfate, dissolved in 800 ml of deionized water. After the internal temperature was raised to 98° C., 260 g of the foregoing resin particle dispersion (1H) and a polymerizable monomer solution of 245 g of styrene, 120 g of n-butyl acrylate, 1.5 g of n-octyl 3-mercaptopropionate, 130 g of releasing agent (1) shown in Table 1 and releasing agent (6) shown in Table 1 which were dissolved at 90° C., were added thereto and mixed with stirring for 1 hr. using a mechanical stirring machine having a circulation route, namely CLEAR MIX (produced by M Technique Co., Ltd.) to prepare a dispersion containing emulsified particles (oil droplets). Subsequently, to this dispersion was added an initiator solution of 6 g of potassium persulfate dissolved in 200 ml of deionized water and this system was heated at 82° C. with stirring over 1 hr. to perform polymerization to prepare resin particle dispersion (1HM).

Third Polymerization Step:

To the foregoing resin particle dispersion (1HM) was added a solution of 11 g of potassium persulfate dissolved in 400 ml of deionized water, and a polymerizable monomer solution of 435 g of styrene, 130 g of n-butyl acrylate, 33 q of methacrylic acid and 8 g of n-octyl-3-mercaptopropionate was dropwise added over a period of 1 hr. at 82° C. After completion of addition, stirring was continued with heating for 2 hr. to perform polymerization. Thereafter, the reaction mixture was cooled to 28° C. to obtain resin particle dispersion A containing resin particles (a). The particle size of the resin particles (a) of the resin particle dispersion A was measured using electrophoresis light scattering photometer ELS-800 (produced by OTSUKA DENSHI CO.) and the volume-based median diameter was determined to be 150 nm. Further, the glass transition temperature of resin particles (a) was 45° C.

Preparations (2-10) of Resin Particle Dispersion

Resin particle dispersions B through N were each obtained similarly to the foregoing preparation (1) of resin particle dispersion A, except that releasing agents (1) and (6) were replaced by releasing agents at the amounts shown in Table 2.

TABLE 1

| Releasing Agent No. | Component | Kind | Melting Point (° C.) |
|---|---|---|---|
| 1 | 1st component | paraffin wax | 52 |
| 2 | 1st component | paraffin wax | 67 |
| 3 | 1st component | polyethylene wax | 72 |
| 4 | 1st component | Fischer-Tropsch wax | 77 |
| 5 | 1st component | Fischer-Tropsch wax | 90 |
| 6 | 2nd component | microcrystalline wax | 83 |
| 7 | 2nd component | microcrystalline wax | 95 |
| 8 | 1st component | Fischer-Tropsch wax | 105 |

TABLE 2

| | | Releasing Agent | | | |
|---|---|---|---|---|---|
| Example No. | Toner No. | 1st Component | 2nd Component | Ratio of 2nd Component (mass %) | Total Content (mass %) |
| 1 | 1 | 1 | 6 | 90 | 15 |
| 2 | 2 | 1 | 6 | 70 | 15 |
| 3 | 3 | 2 | 6 | 60 | 15 |

TABLE 2-continued

| Example No. | Toner No. | Releasing Agent 1st Component | 2nd Component | Ratio of 2nd Component (mass %) | Total Content (mass %) |
|---|---|---|---|---|---|
| 4 | 4 | 3 | 6 | 30 | 15 |
| 5 | 5 | 4 | 6 | 10 | 15 |
| 6 | 6 | 5 | 7 | 8 | 15 |
| 7 | 7 | 5 | 7 | 5 | 15 |
| Comp. 1 | 8 | 1 | — | 0 | 15 |
| Comp. 2 | 9 | — | 6 | 100 | 15 |
| Comp. 3 | 10 | 8 | 6 | 30 | 15 |

Preparation of Colorant Microparticle Dispersion:

To a solution of 90 g of sodium dodecylsulfate dissolved in 1600 ml of deionized water was gradually added 420 g of carbon black, REGAL 330R (produced by Cabot Co.). Subsequently, a dispersing treatment was conducted using a stirrer, CLEAR MTX (M Technique Co.) to prepare a dispersion (Q) of colorant microparticles. The colorant particle size of the dispersion (Q) was measured using electrophoresis light scattering photometer ELS-800 (produced by OTSUKA DENSHI CO.) and the volume-based median diameter was determined to be 110 nm.

Preparation of Toner Particles (1):

To a 5 liter reaction vessel fitted with a stirrer, a temperature sensor, a condenser and a nitrogen gas introducing device was placed resin particle dispersion (A) at a solid content of 300 g, 1400 g of deionized water and 3 g of polyoxyethylene 2-dodecyl ether sodium sulfate which were dissolved in 120 ml of deionized water, and after adjusted to a liquid temperature of 30° C., the pH was adjusted to 10 with an aqueous 5N sodium hydroxide solution. Subsequently, an aqueous solution of 35 g of magnesium chloride dissolved in 35 ml of deionized water was added thereto at 30° C. over 10 min. with stirring. After being maintained for 3 min., the temperature was raised to 90° C. over 60 min. and maintained at 90° C. to promote particle growth reaction. While measuring coagulated particle sizes using COULTER MULTISIZER III and when reached the intended particle size, an aqueous solution of 150 g of sodium chloride dissolved in 600 ml of deionized water was added thereto to terminate particle growth. Further, ripening is performed at 98° C. with stirring to promote fusion between particles until reached an average circularity of 0.965, allowing hydrophobic resin to orient toward the surface side of the coagulated particles and hydrophilic resin to orient toward the interior side of the coagulated particles to form toner particles having a core/shell structure. Then, cooling was conducted until reached 30° C. and the pH was adjusted to 4.0 with hydrochloric acid and stirring was terminated.

The thus formed toner particles were subjected to solid/liquid separation by using a basket type centrifugal separator, MARK III type No. 60×40 (produced by Matsumoto Kikai Co., Ltd.) to form a wet cake of the toner particles. The wet cake was washed with 45° C. deionized water by using the basket type centrifugal separator until the filtrate reached an electric conductivity of 5 μS/cm, transferred to FLASH JET DRYER (produced by Seishin Kigyo Co.) and dried until reached a moisture content of 0.5% by mass to obtain particle used for a toner.

To the obtained particles, hydrophobic silica (number average primary particle size of 12 nm) and hydrophobic titania (number average primary particle size of 20 nm) were added in amounts of 1% by mass and 0.3% by mass, respectively, and mixed in a HENSCHEL MIXER to prepare Toner 1 comprised of toner particles (1). The toner particles were not varied by addition of hydrophobic silica or hydrophilic titanium oxide, with respect to form or particle size.

Preparation of Toner Particles (2) to (10):

Toners 2 to 10 which were respectively comprised of toner particles (2) to (10), were prepared similarly to the foregoing manufacture of toner particles (1), except that the resin particle dispersion A was replaced by each of resin particle dispersions B to J.

Preparation of Developer:

Each of the toner particles (1) to (10) was mixed with a silicone resin-coated ferrite carrier exhibiting a volume average particle size of 60 μm at a toner content of 6% to prepare developers 1-7 and comparative developers 1-3, respectively.

Examples 1-7 and Comparative Examples 1-3

The thus prepared developers 1-7 and comparative developers 1-3 were each subjected to practical picture tests using a digital copier, BIZHUB PRO C350 (produced by Konica Minolta Corp.) which was installed with the fixing device described below and evaluated according to the following items (I) to (II). Results are shown in Table 3.

The fixing device used in the test was one of a contact heating system. Specific constitution is as follows. A heating roller comprised of a cylindrical aluminum alloy core (inside diameter of 40 mm, wall thickness of 2.0 mm), the surface of which was covered with 120 μm thick PTFE (tetrafluoroethylene) and having a heater in the central portion, and a pressure roller comprised of a cylindrical iron core (having an inside diameter of 40 mm and a wall thickness of 2.0 mm), the surface of which was covered with silicone sponge rubber (exhibiting an Asker C hardness of 48° and having a thickness of 2.0 mm) were placed in contact with each other under a total load of 150N, forming a 5.8 mm wide fixing nip portion. The fixing device was used at a linear printing speed of 160 mm/sec, while controlling the fixing temperature at 120° C., 140° C. or 160° C.

(I) Image Defect:

Under an environment of ordinary temperature and humidity (20° C., 55% RH), 10,000 sheets of mixed images composed of a text image having a picture element ratio of 7%, a portrait photographic image and a solid cyan half-tone image having a relative image density of 0.6, formed on J Paper of 64 g/m$^2$ (produced by Konica Minolta Corp.) were printed as a test image, while maintaining the fixing belt temperature at 120° C., 140° C. or 160° C. The test image obtained on the 10000th sheet was visually observed with respect to banding or white-streaking image defects and evaluated based on the following criteria:

A: no image defect was observed,

B: slightly density-reduced streaks were observed in the solid cyan halftone image, C: some white-streaks were observed in the solid cyan halftone image but not noticed markedly in the text image and portrait photographic image and acceptable in practical use, D: white-streaks were definitely observed in the solid cyan halftone image and unacceptable in practical use.

(II) Separability in Fixing:

Under an environment of ordinary temperature and humidity (20° C., 55% RH), the surface temperature of a heating roller was controlled to a temperature shown in Table 3 and an A4 image having a solid black banded image of a 5 mm width vertical to the transport direction was formed on a A4 size fine-quality paper (64 g/m$^2$) and transported in the machine direction. Separability of the paper from the image side of the heating roller was evaluated, based on the following criteria:

A: separation from the heating roller was achieved without curling the A4 fine-paper, B: the A4 fine-paper was separable from the heating roller by a separating claw and no separating claw mark was noticed, C: the A4 fine-paper was separable from the heating roller by a separating claw but a separating claw mark was hardly noticed, D: the A4 fine-paper was separable from the heating roller by a separating claw but the separating claw mark remained, or the A4 paper was wound around the heating roller and not separable therefrom.

TABLE 3

| | Fixing | Evaluation | |
|---|---|---|---|
| Example No. | Temperature (° C.) | Image Defect | Separability |
| 1 | 130 | C | A |
| 2 | 120 | B | A |
| 3 | 110 | A | A |
| 4 | 100 | A | A |
| 5 | 100 | A | A |
| 6 | 130 | A | B |
| 7 | 150 | A | C |
| Comp. 1 | 110 | D | A |
| Comp. 2 | 110 | A | D |
| Comp. 3 | 130 | A | D |

As apparent from the results shown in Table 3, it was proved that Examples 1-7 relating to the toner of the invention resulted in no image defects such as banded or streaked image defect even when fixed at a relative low temperature and superior separability (releasing capability) from the transfer material was realized.

What is claimed is:

1. An electrophotographic toner comprising a binding resin, a colorant and a releasing agent, wherein the releasing agent comprises a first releasing agent component and a second releasing agent component, the first releasing agent component is a straight chain hydrocarbon compound exhibiting a melting point of 50 to 100° C. and the second releasing agent component is a branched hydrocarbon compound exhibiting a melting point of 50 to 100° C. and the second releasing agent component accounting for 5% to 90% by mass of the total amount of the first and second releasing agent components, and wherein the straight chain hydrocarbon compound exhibits a weight average molecular weight (Mw) of 300 to 500 and a number average molecular weight (Mn) of 300 to 500, and the ratio (Mw/Mn) of the weight average molecular weight to the number average molecular weight being from 1.0 to 1.20.

2. The toner of claim 1, wherein the first component exhibits a melting point of 55 to 90° C. and the second component exhibits a melting point of 55 to 90° C.

3. The toner of claim 1, wherein the second releasing agent component accounts for 10% to 60% by mass of the total amount of the first and second releasing agent components.

4. The toner of claim 1, wherein the first releasing agent component is at least one selected from the group of a paraffin wax, Fischer-Tropsch wax or a polyethylene wax.

5. The toner of claim 1, wherein the second releasing agent component is at least one selected from the group of microcrystalline wax or an isoparaffin wax.

6. The toner of claim 1, wherein the second releasing agent component is a microcrystalline wax exhibiting a weight average molecular weight of 600 to 800 and a melting point of 60 to 85° C.

7. The toner of claim 1, wherein in the branched hydrocarbon compound, the sum of tertiary and quaternary carbon atoms accounts for 0.1% to 20% of total carbon atoms of the hydrocarbon compound.

8. The toner of claim 1, wherein the releasing agent is contained in an amount of 1% to 30% by mass of the binding resin.

* * * * *